US008356534B2

(12) United States Patent
Hale et al.

(10) Patent No.: US 8,356,534 B2
(45) Date of Patent: Jan. 22, 2013

(54) FASTENER DRIVING SYSTEM WITH PRECISION FASTENER GUIDE

(75) Inventors: Troy Hale, Goodlettsville, TN (US); Jeremy Scott Park, Bethpage, TN (US)

(73) Assignee: Simpson Strong-Tie Company, Inc., Pleasanton, CA (US)

( * ) Notice: Subject to any disclaimer, the term of this patent is extended or adjusted under 35 U.S.C. 154(b) by 0 days.

(21) Appl. No.: 12/116,857

(22) Filed: May 7, 2008

(65) Prior Publication Data

US 2008/0276761 A1 Nov. 13, 2008

Related U.S. Application Data

(60) Provisional application No. 60/916,506, filed on May 7, 2007.

(51) Int. Cl.
*B25B 23/10* (2006.01)
*B25B 23/04* (2006.01)

(52) U.S. Cl. ..... 81/57.37; 81/452; 81/434; 81/418

(58) Field of Classification Search ..... 81/434, 81/44, 57.37, 431, 418, 451, 452, 454; 227/18, 227/119, 147
See application file for complete search history.

(56) References Cited

U.S. PATENT DOCUMENTS

| | | | | |
|---|---|---|---|---|
| 1,726,012 | A * | 8/1929 | Bilz | 81/44 |
| 4,454,650 | A * | 6/1984 | Silver | 29/818 |
| 4,773,156 | A * | 9/1988 | Kurita | 29/783 |
| 5,568,753 | A | 10/1996 | Habermehl et al. | |
| 5,570,618 | A | 11/1996 | Habermehl et al. | |
| 5,810,239 | A * | 9/1998 | Stich | 227/119 |
| 5,870,933 | A | 2/1999 | Habermehl et al. | |
| 6,164,170 | A | 12/2000 | Habermehl et al. | |
| 2007/0267459 | A1 | 11/2007 | Yang | |

FOREIGN PATENT DOCUMENTS

| | | |
|---|---|---|
| DE | 3631654 A1 | 4/1987 |
| EP | 1226901 A | 7/2002 |
| EP | 1825962 A | 8/2007 |
| JP | 2000198086 A | 7/2000 |
| WO | 2006057286 A | 6/2006 |

OTHER PUBLICATIONS

International Search Report and Written Opinion dated Aug. 14, 2008 in PCT Application No. PCT/US/2008/062939.

* cited by examiner

*Primary Examiner* — Hadi Shakeri
(74) *Attorney, Agent, or Firm* — Vierra Magen Marcus & DeNiro LLP

(57) ABSTRACT

An apparatus for positioning a fastener in a driving system. A positioning assembly is positioned at the first end of a guide tube to engage a fastener driven by a driver shaft out of the guide tube. The positioning assembly includes a first jaw having an interior cavity and a mounting portion allowing the jaw to be mounted to the guide tube. The positioning assembly includes a second jaw having an interior cavity and a mounting tab allowing the jaw to be mounted to the guide tube. The first and second jaw are rotatably coupled to the guide tube in a retractable manner such that a fastener exiting the guide tube separates the jaws and is centered about the axis passing longitudinally through the guide tube.

21 Claims, 10 Drawing Sheets

FASTENER DRIVING SYSTEM WITH PRECISION FASTENER GUIDE

CLAIM OF PRIORITY

This application claims the benefit of U.S. Provisional Application No. 60/916,506, "Fastener Driving System With Precision Fastener Guide," filed on May 7, 2007, inventors Clark, et al. which is incorporated herein by reference.

BACKGROUND

Power screwdrivers for driving collated screw strips have a number of uses in the construction industry. Examples of such power driven screwdrivers are shown in include U.S. Pat. No. 5,568,753 to Habermehl, issued Oct. 29, 1996; U.S. Pat. No. 5,870,933 to Habermehl, issued Feb. 16, 1999 and U.S. Pat. No. 5,570,618 to Habermehl et al., issued Nov. 5, 1996. Additional examples of such systems are commercially available under the name QuikDrive® from Simpson Strong-Tie Company, Inc., Pleasanton, Calif.

Certain types of powered screwdrivers utilize an automatic feed screwdriver in which a housing is secured to a power driver. The housing includes a screw feed channel to receive the screw strips holding a plurality of screws. The screws held in the screw strips are advanced sequentially to a point where each successive screw to be driven is coaxially arranged within a bore of a guide tube in line with a driver shaft. Pressure applied by the user in conjunction with the application of power to the driver allows the screw to be driven into the workpiece.

Normally, the fasteners are held by the screwstrips until driven into the workpiece.

These prior art auto feed screwdrivers provide for various linkages between the driver body and the housing such that on reciprocal telescopic sliding of the slide body into and out of the housing between extended and retracted positions, the linkages cause automatic advance of the screwstrip in the feed guide channel.

Known power driven systems generally have an open end though which the fasteners advance into the work piece. In certain applications, greater accuracy than available using current power driven screwdrivers is required. Installers may need to find a particular pre-drilled hole. Currently, users place a screw gun over the hole and "hope for the best."

SUMMARY

Technology is described for accurately positioning a fastener relative to a workpiece and in particular a pre-drilled hole in the workpiece. In one aspect, the apparatus is an apparatus for driving a threaded fastener. The apparatus includes a driver guide tube having a first end and an elongated driver shaft in the guide tube. The driver shaft has a rear end coupled to a power driver and a forward end carrying a bit. The driver shaft defines a longitudinal axis. A positioning assembly is positioned at the first end of the guide tube to engage a fastener driven by the driver shaft out of the guide tube.

In one aspect the positioning assembly includes a first jaw having an interior cavity and a mounting portion allowing the jaw to be mounted to the guide tube. In addition, the positioning assembly includes a second jaw having an interior cavity and a mounting tab allowing the jaw to be mounted to the guide tube. The first and second jaw are rotatably coupled to the guide tube in a retractable manner such that a fastener exiting the guide tube separates the jaws and is centered about the axis passing longitudinally through the guide tube.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DETAILED DESCRIPTION

A positive placement, power driven fastener driving system is provided that increases the accuracy of fastener placement for an installer. A positioning assembly on the driving system ensures that the fastener will exit the driver and enter the work piece at the location where the positioning assembly abuts the work piece and along an axis defined by a drive shaft of the driving system.

Figure 2:
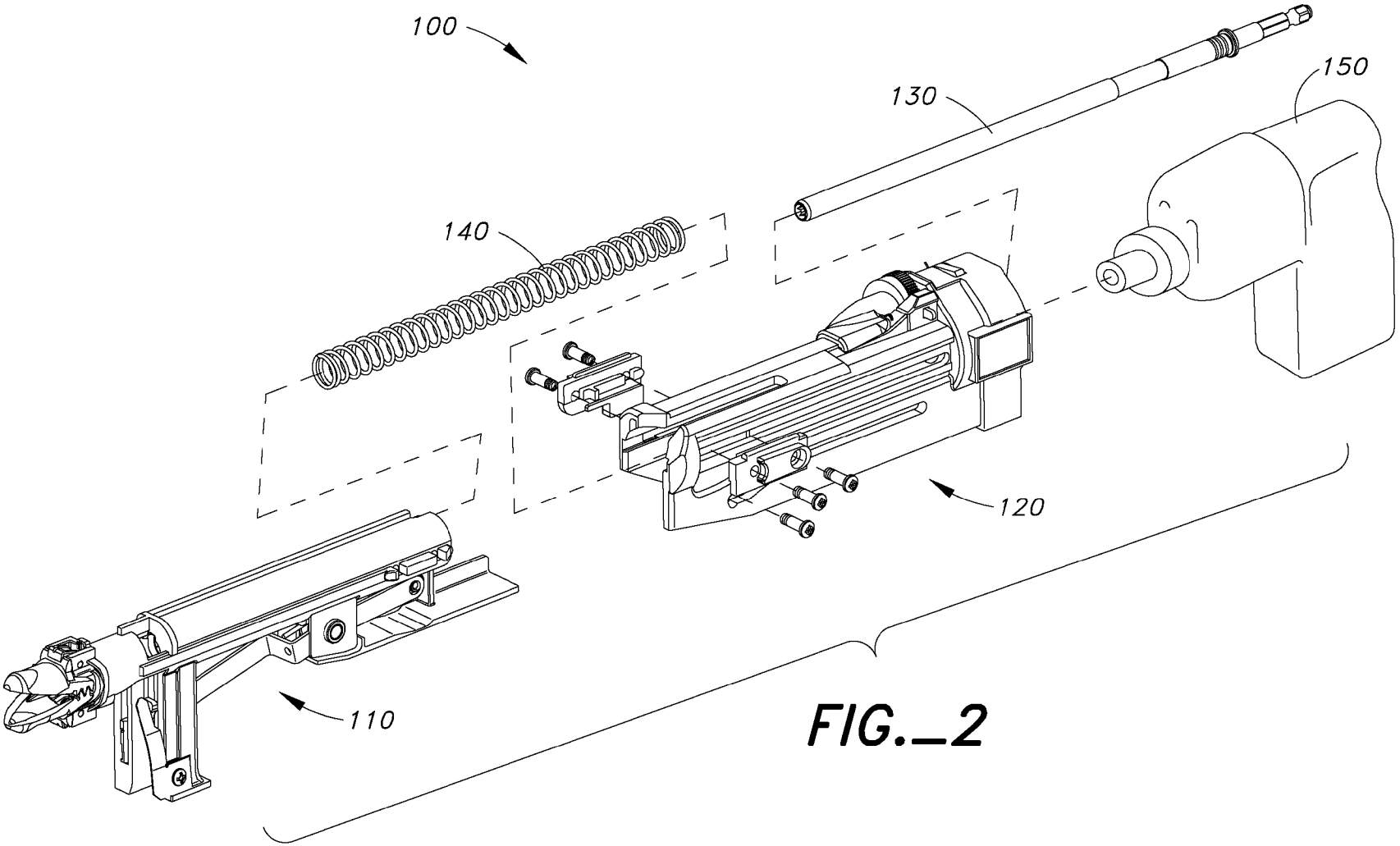
FIG. 2 is a perspective, exploded view of a guide tool assembly used in conjunction with a housing assembly.

FIG. 2 shows an exploded, perspective view of the driving system 100. The driving system 100 includes a power driver 150, housing assembly 120 and positive placement assembly 110 (also referred to as guide tube assembly). The driving system 100 is adapted for use with a number of commercially available power drivers 150. As shown in FIG. 2, and as known to one skilled in the art, a mandrel assembly 130 and return spring 140 are positioned within housing assembly 120 and positive placement assembly no to advance a rotating and reciprocating bit driven by the power driver 150 to drive fasteners into a work piece.

The driving system is designed to drive fasteners comprising screws provided in a screwstrip. The screwstrips hold the screws connected to each other by a retaining belt generally made of plastic material. Screws in such strips are engaged by a bit of a screwdriver and then screwed into a workpiece. In the course of the bit engaging the screw and/or driving the same into the workpiece, the screw becomes detached from the plastic strip.

Screws carried by such strips are adapted to be successively incrementally advanced to a position in alignment with a reciprocating, rotating power bit and screwed into a workpiece. In the strip, each screw to be driven has its threaded shaft engaged in a threaded sleeve of the strip such that on the screwdriver engaging and rotating each successive screw, the screw turns within the sleeve which acts to guide the screw as it moves forwardly into threaded engagement into the workpiece. Further forward movement of the screw into the workpiece then draws the head downward to engage the sleeve and rupture the sleeve by reason of the forward movement of the head with the strip retained against movement towards the workpiece. Advancing the strip with each successive screw to be driven results in portions of the strip from which each screw has been driven are advanced to exit from the driving system.

Figure 10:
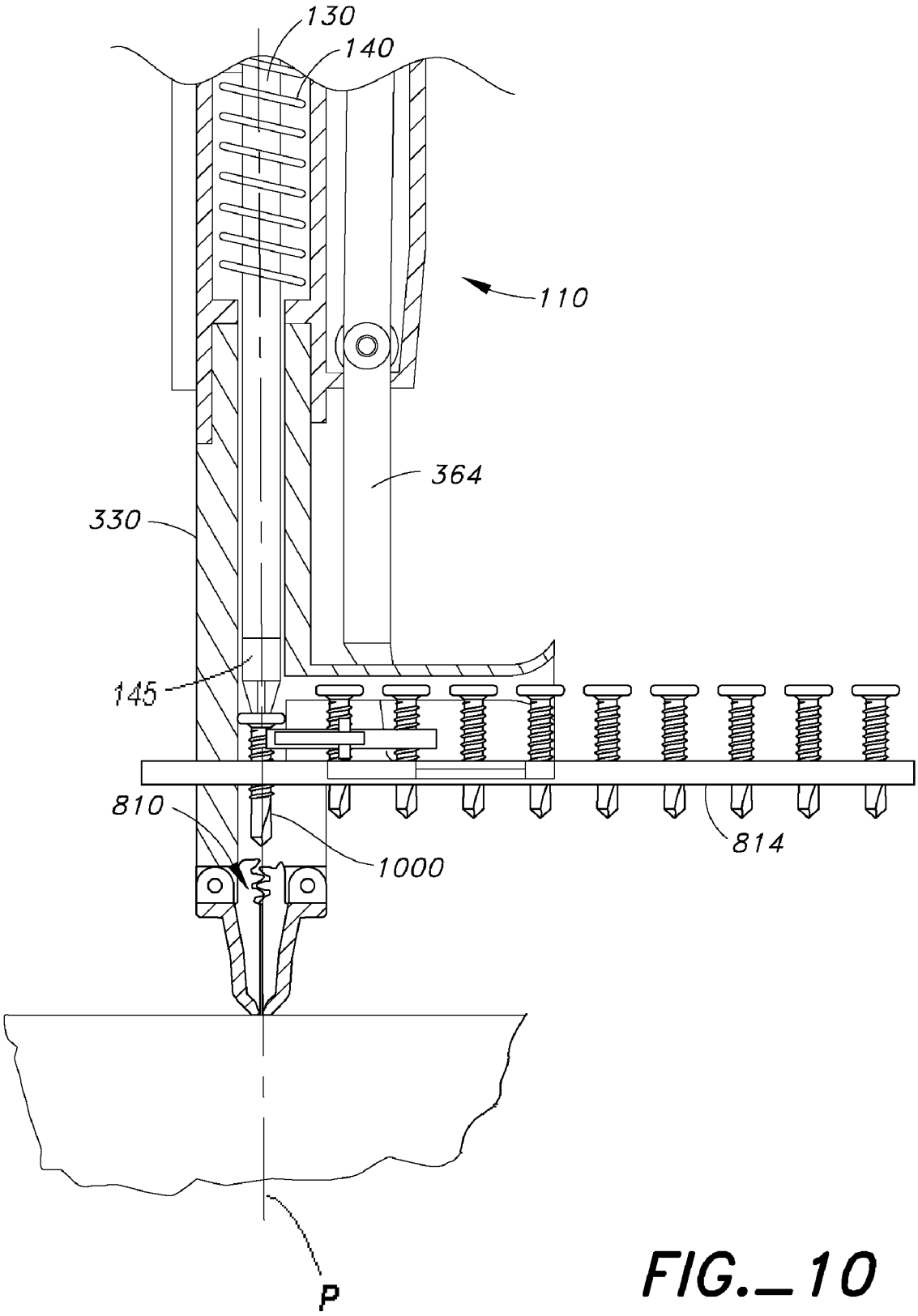
FIGS. 10-14 are side views of the tool assembly as a screw is driven into a work piece through the guide tool assembly.

Driving of screws in this manner is well known in the art and generally illustrated in U.S. Pat. No. 6,164,170. In tool 100, the mandrel and driving bit are aligned on an axis P extending the length of the mandrel. As shown in FIG. 10, axis P extends though the work piece and defines the position where the screw will enter the work piece.

Figure 1:
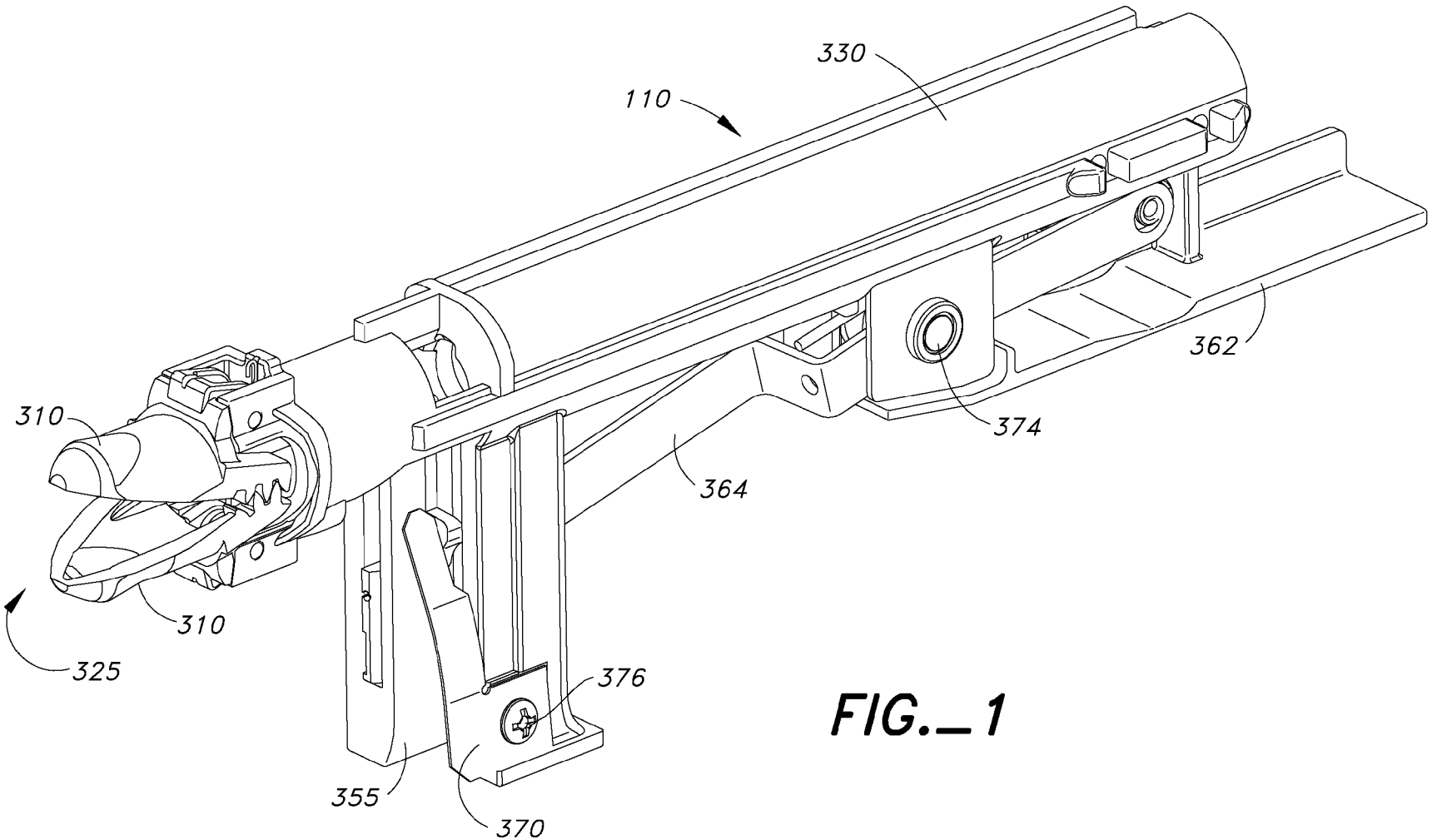
FIG. 1 depicts a perspective view of a guide tool assembly in accordance with the present technology.
Figure 3:
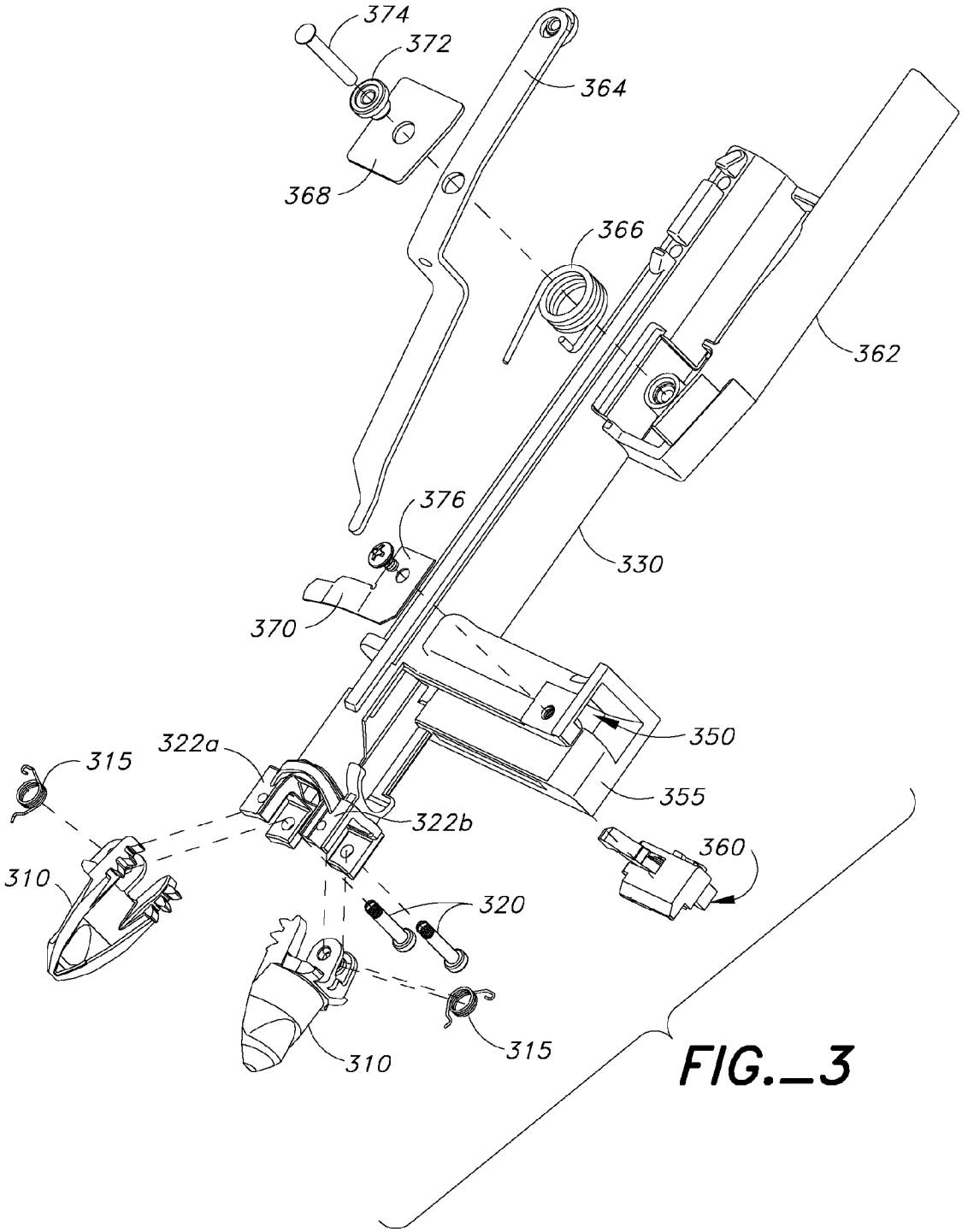
FIG. 3 is a partially exploded perspective view of the guide tool assembly shown in FIG. 1.
Figure 4:
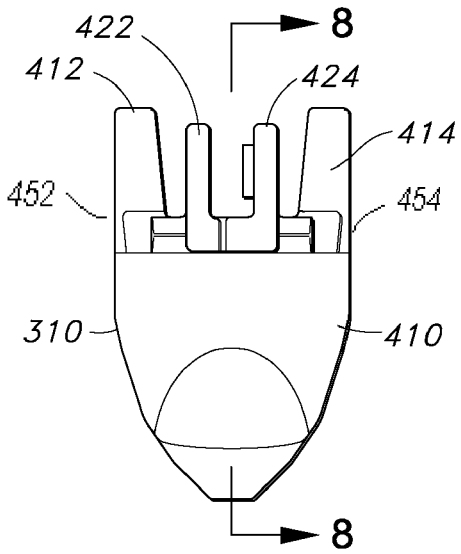
FIG. 4 is a plan view of the exterior of a screw guide jaw.

FIG. 1 shows an assembled, perspective view of the guide tube subassembly 110. FIG. 3 is an exploded, perspective view of the guide tube subassembly. With reference to FIGS. 1 through 3, the guide tube assembly 110 is adapted to receive a collated screwstrip 814 (shown in FIGS. 10 through 14) which carries spaced screws 1000 to be successively driven into a work piece.

Figure 6:
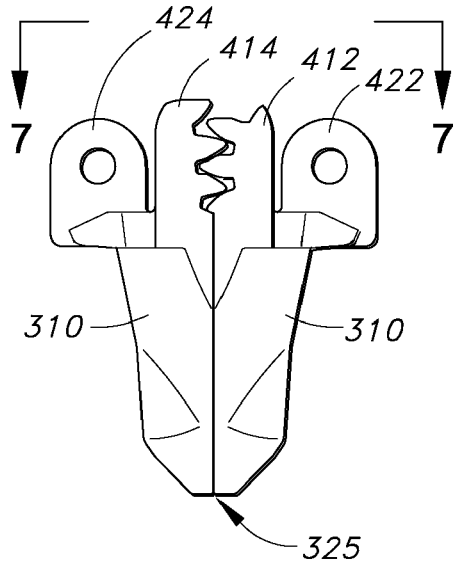
FIG. 6 is a side view of two facing screw guide jaws comprising a positioning assembly.

The guide tube assembly 110 includes a guide tube 330 which houses the mandrel assembly and driving bit (shown in FIGS. 10-14). Two positioning jaws 310 are mounted in opposing fashion to one end of the guide tube 330 and form, with springs 315, a positioning assembly 325. Jaws 310 are mounted to brackets 322(*a*) and 322(*b*) positioned at the end of the guide tube channel 332 to form a positioning assembly 325. Jaws 310 are secured in tabs 322(*a*) and 322(*b*) by pins 320 passing through bores in tabs 322(*a*) and 322(*b*), and corresponding tabs 422, 424 on each jaw 310. A coil spring 315 is positioned within each jaw 310 and has a first portion abutting the jaw and a second portion abutting the end of the guide tube assembly. Each coil spring forces the jaws 310 into abutment adjacent to each other in a closed position as shown in FIG. 6.

A channel element 355 includes a channel 350 for receiving the collated screw strip. A feed pawl carrier assembly 360 is positioned in a slot (not shown) in channel element 355 and is attached to a screw advance assembly comprising grip 362 and lever 364. Lever 364 has a first end coupled to the feed pawl carrier assembly 360 and a second end attached to grip 362. Feed carrier assembly 360 advances screws in the carrier in a manner shown in U.S. Pat. No. 6,164,170. Lever 364 is pivotally attached to guide tube 330 utilizing a pin 374, washer 372, mounting plate 368 and coil spring 366. The feed pawl assembly is slidably mounted in the channel element for sliding in a raceway [not shown] and transfers motion of the lever 364 to the pawl assembly. As shown in FIG. 1, a stop plate 370 is attached to the channel element 355.

The guide tube 330 has a cylindrical bore extending through the guide tube which is open at its forward axial end 335. This is illustrated in FIGS. 10 through 14.

While the invention is shown as utilized with a collated screw strip, an automatic feeding mechanism for fasteners is not a critical component of the technology described herein. The positioning assembly may be utilized with numerous types of fasteners and fastening systems.

FIGS. 4 through 9 show various features of the jaws 310 making up the placement assembly 325. Jaws 310 are manufactured of metal such as 86200 grade steel. As discussed below, the placement assembly is designed to ensure that the fastener exiting the tool is aligned in three dimensions on axis P so that it enters the work piece at the location desired by the user. In this respect, the placement assembly 325 maintains the position of the fastener in the x and y directions shown in FIG. 7 as a result of the features discussed below.

Figure 7:
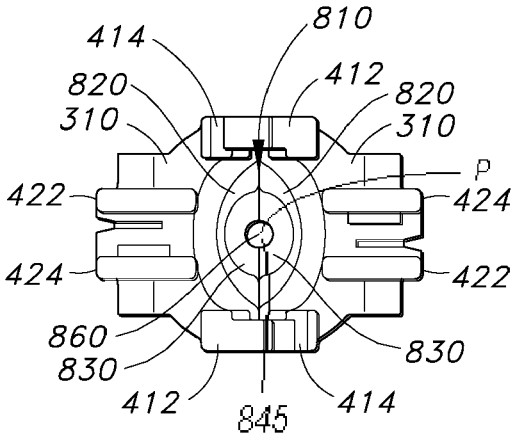
FIG. 7 is a top view of the positioning assembly shown in FIG. 6.

Each jaw 310 has an outer surface 410 and a partial inner cavity 415 defined by a series of inner walls 820, 830, 840, 850, 860 and rolled edge 870. A face 815 defines the edge of the inner walls and is designed to mate with a face of an opposing jaw 310. The outer surface terminates in a base 855 which an installer positions on the point at which the installer wishes the screw to enter the work piece. Two cavities 415 jointly form an inner chamber 810 when two jaws 310 abut each other as shown in FIGS. 6 and 7. FIGS. 6 and 7 illustrate the closed position of the jaws which is maintained by the coil springs 315 when the jaws are installed on the guide tube 330. In operation, the assembly 325 remains closed under the force exerted by the coil springs 315 unless forced open by a fastener exiting the tool 100. Each jaw 310 further includes the mounting tabs 422, 424 and synchronization gears 412 and 414. Mounting tabs include bores for receiving pins 320 when mounting a jaw in one of guide tube tabs 322*a*, 322*b*.

Figure 5:
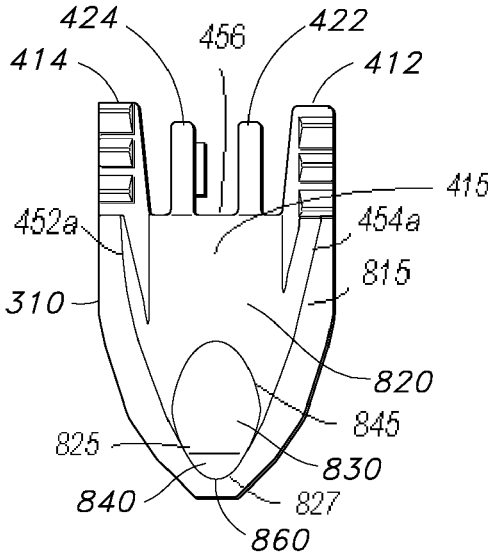
FIG. 5 is a plan view of the interior of a screw guide jaw.

Synchronization gears 412 and 414 each include a plurality of teeth arranged so that when two respective jaws 310 are engaged in an opposing relationship as shown in FIG. 6, the teeth mesh and continue to do so when rotated about the rotational axes defined by mounting pins 320 when positioned in tabs 322*a* and 322*b*. As illustrated in FIG. 5, the teeth of gear 412 are offset in relation to those of gear 414, so that all jaws 310 can be manufactured identically and mesh with any other jaw 310.

Gears 412, 414 ensure that when each jaw 310 is rotated about its respective pin 320 as a fastener exits the guide tube assembly, the amount of relative rotation of both jaws 310 is the same. This synchronization ensures that the fastener exiting the guide 325 is centered on the axis P in the y direction (FIG. 7) and maintains the accuracy of the positioning of the fastener relative to the work piece.

Figure 8:
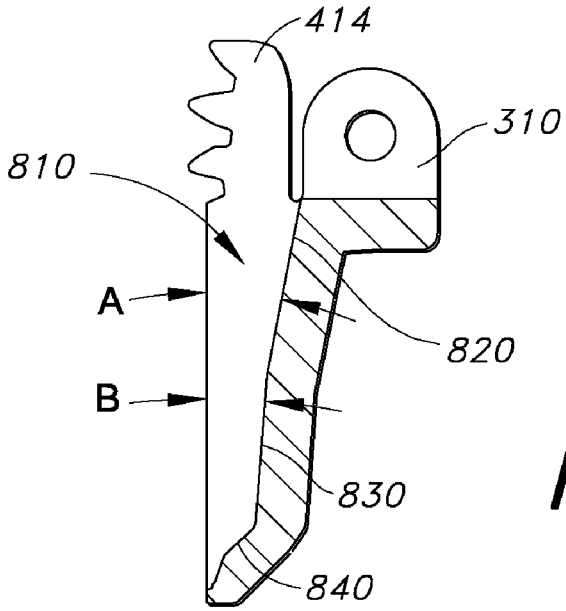
FIG. 8 is a cross section of the screw guide jaw along line 8-8 in FIG. 4.
Figure 9:
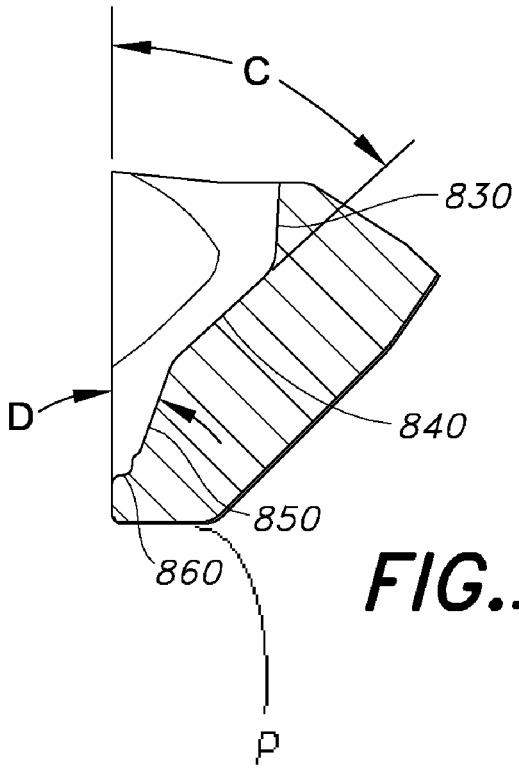
FIG. 9 is an enlarged view of a portion of FIG. 8.

As illustrated in FIGS. 7, 8 and 9, the interior cavity 810 of the jaw positioning assembly 325 is formed by inner walls 820, 830, 840, 850 860 and rolled edge 870. As illustrated in FIG. 7, inner wall 820 has an arcuate shape such that the portions of wall 820 adjacent to ends 452 and 454 are farther than those nearest to the center each jaw 310, closer to axis P. In one embodiment, the arcuate cross section has an arc shape defined by a radius measured from a point 0.15 inch offset from axis P away from the surface 820, the radius being approximately 0.35-0.4 inch. The resultant "football" shaped cross section is shown in FIG. 7. This cross section is maintained in decreasing size until the inner wall 830 begins a section of generally circular cross-section when viewed from the top down as shown in FIG. 7. This change point is illustrated in FIGS. 5 and 7 at line 845.

The arcuate form of wall 820 and circular form of walls 830 allow the screw fastener 1000 to enter the interior of the jaw assembly 325 without gripping the walls and to be accurately fed to center the fastener axis in alignment with axis P. The arcuate and circular cross sections ensure centering of the screw in both the x and y directions as it advances through the jaw assembly 325. The arcuate section defined by wall 820 ensures initially aligns the fastener along the x direction but without allowing the fastener to grip the interior of the assembly 325. The arcuate section feeds the fastener into the circular section defined by walls 830, which centers the fastener on axis P prior to exit from assembly 325.

As detailed in FIGS. 8 and 9, walls 820 and 830 have a steeper angle than the base portion of the jaw assembly defined by walls 840, 850 and 860. Wall 820 is defined at an angle A of approximately 11° and wall 830 is defined at an angle B of approximately 3.8°. Once the fastener reaches wall 840 defined at an angle C of approximately 45° and wall 850 at an angle D of approximately 20°, the tip of the fastener will be centered in a cavity defined by base wall 860 and rolled edge 870. Base wall 860 and rolled edge 870 ensure that the tip of the fastener is provided at a specific point within the assembly 325, directly aligned on axis P, prior to exit from the tool. The radius of curvature defining edge 870 can be approximately 0.005 to 0.0010".

It will be understood that all dimensions given herein are exemplary and may be modified or scaled in accordance with the teachings herein to accomplish the teachings herein.

In addition, each jaw is tapered so that the chamber 415 is smaller near the base 855 than near the top 456 of the jaw. Inner walls 830, 840 have a taper as illustrated by the converging edges 825, 827 near the base 855 of the jaw 310. Hence the width of the chamber 415 defined by edges 452*a* and 454*a* is greater than that defined at edges 825, 827. In one embodiment, the width at the mouth of chamber 415 is approximately 0.5-0.6 inch, and in one embodiment 0.57 inch, while that at wall 850 is about 0.15 inch. However, base 855 is essentially flat. Hence, the screw has a mechanical advantage on the interior of the jaws to actually pry the jaws out of the hole. The angle of the surface seen by the screw on the inside (surface 850) and that which is pried apart by the screw, is much steeper than the outside surface 865. Thus, the screw has a mechanical advantage against any resistance from the surface or a hole against the exterior surface 865.

FIGS. 10 through 14 illustrate the passage of a fastener through the guide assembly. As shown in FIG. 10, a screwstrip 814 is placed in the feed channel element 355. The screw strip has a number of fasteners 1000 attached thereto in a manner such as that shown in U.S. Pat. Nos. 7,051,875, 5,758,768, and 6,494,322. The screws 1000 to be driven are collated to be held in parallel and spaced apart from each other in the retaining strip 814. In use, each successive screw to be engaged and driven into the work piece is advanced into actual alignment with the mandrel 130 and bit 145 by the pawl assembly 360. To drive a screw into the work piece, the motor (not shown) is activated to rotate mandrill 130 and the mandrill 130 and bit 145 are reciprocally moveable in the guide towards and away from the work piece. Pressure from the user pushes the mandrel 130 and bit 145 toward the work piece against the bias of spring 140. After installation, the compressed spring returns the mandrill and bit back from the work piece on a return stroke. As the mandrill 130 and bit 145 is actually moved toward the work piece, the bit 145 engages the fastener 1000 to turn the fastener 1000 in rotation. As is known, the plastic strip 814 is formed to release the screw as it is first turned in rotation by the bit. Hence, as shown in FIG. 10, once driven out of the screwstrip, a fastener 1000 is now free of the strip 814 and positioning control is delegated to assembly 325 and bit 145.

Figure 11:
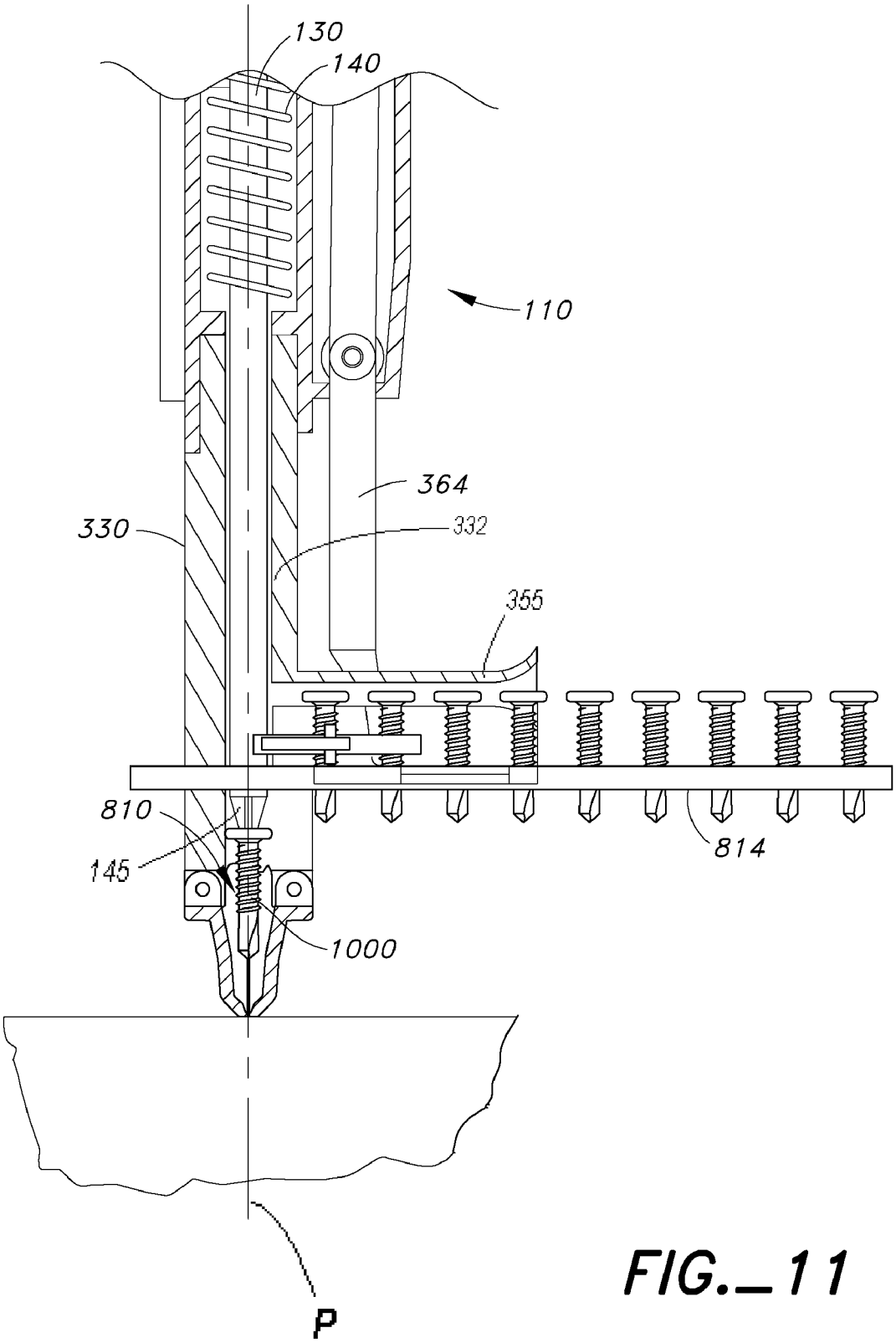

As the user forces the screw into the positioning assembly 325, as shown in FIG. 11, the tip of the fastener first engages walls 820 and any mis-alignment relative to axis P will be initially corrected by the shape and angle of walls 820. Because of the cross section of the walls 820, fasteners which are screws will not grip the interior of the positioning assembly 325. Such gripping by the fastener can cause the user to feel resistance when using the tool 100.

Figure 12:
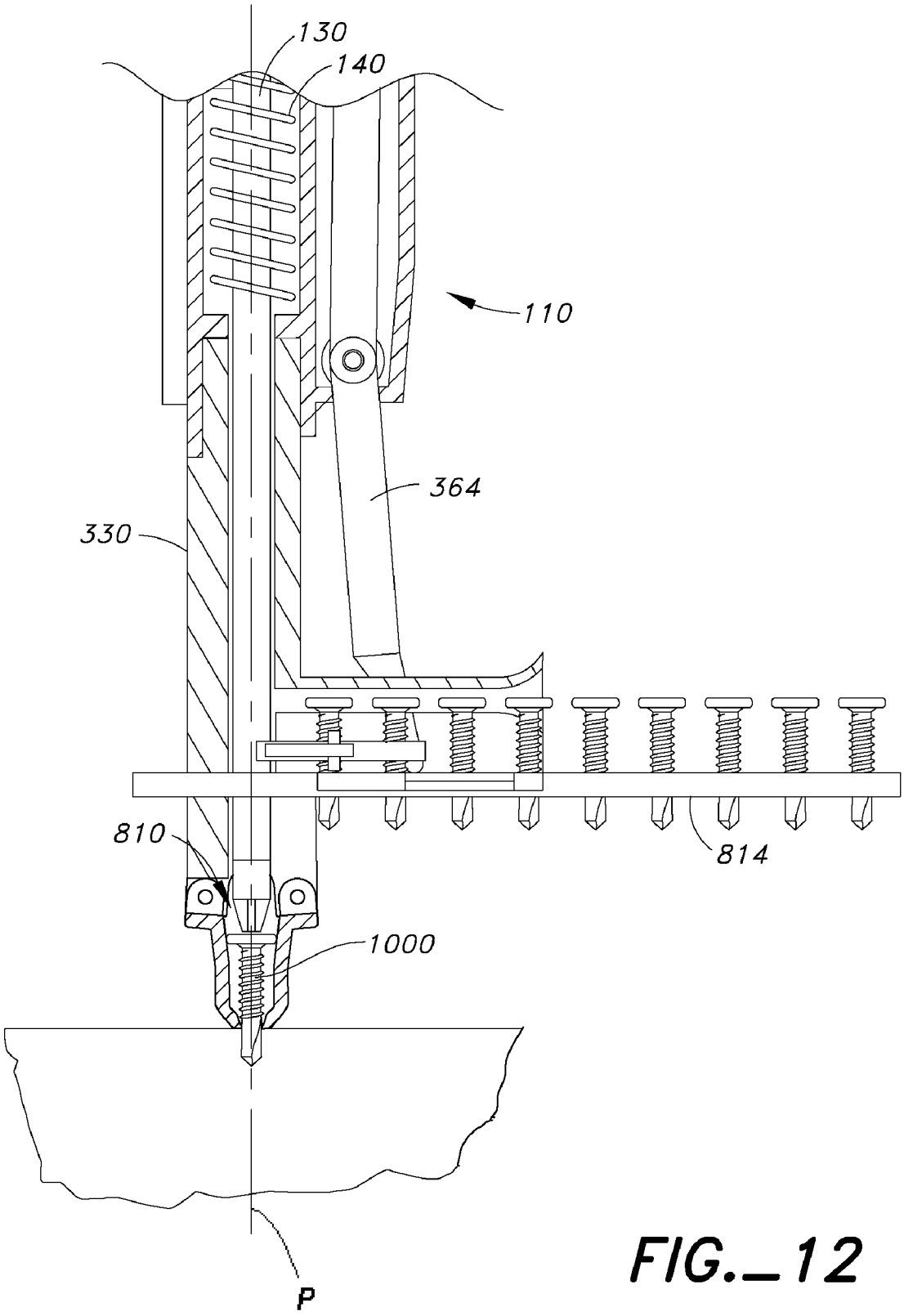
Figure 13:
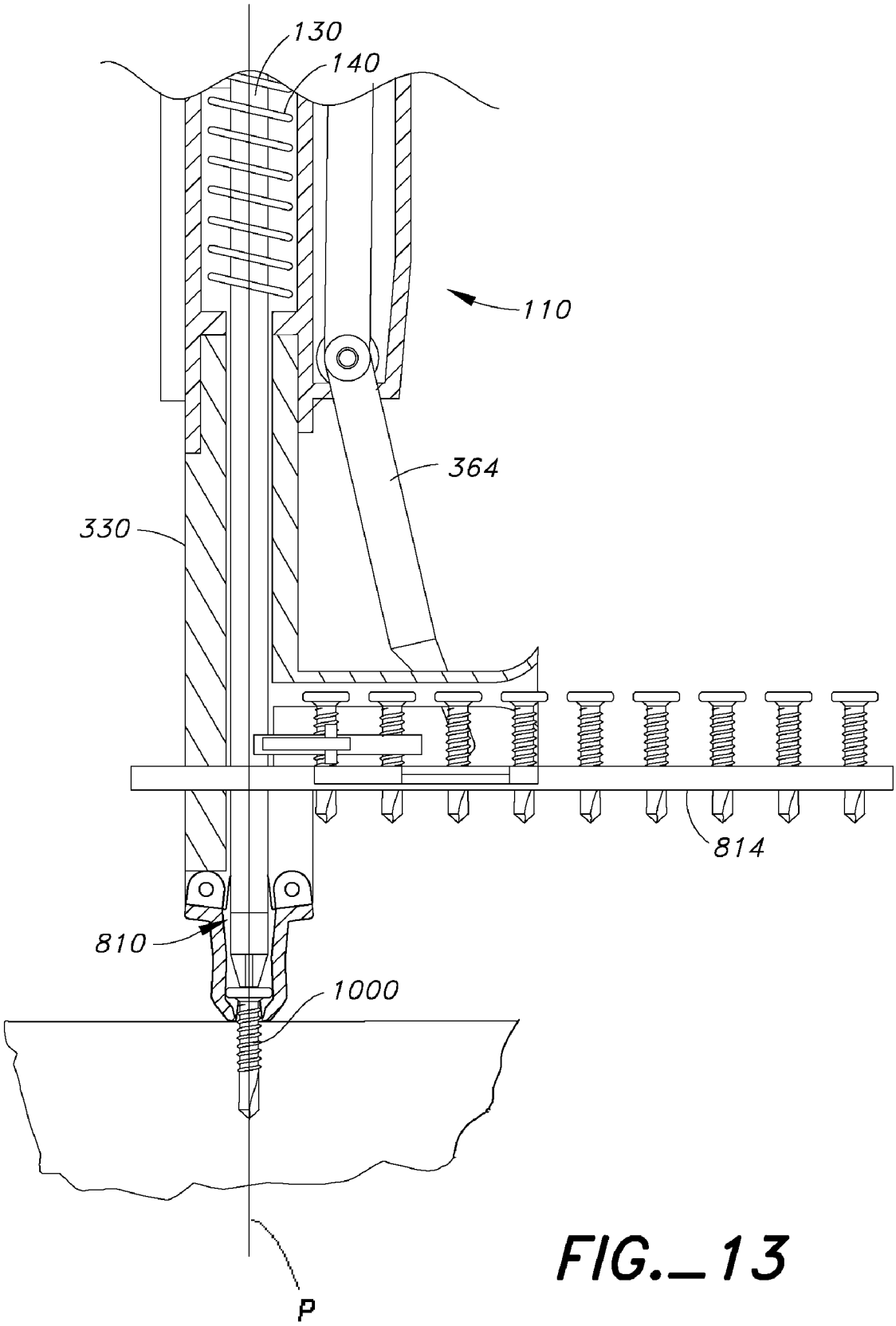
Figure 14:
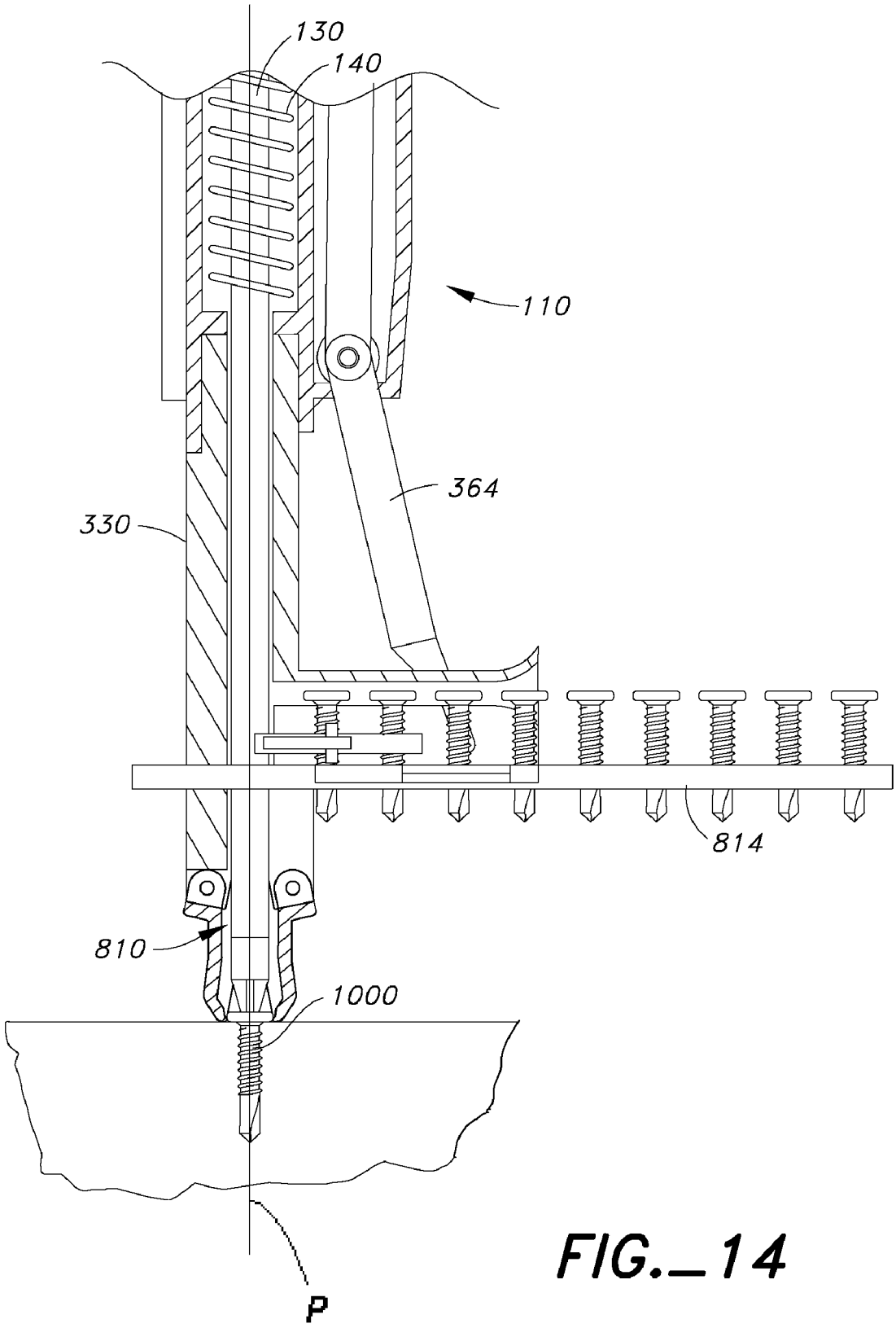

As the fastener moves further into the chamber 810, it will abut and be positioned by walls 830, before resting on walls 840 with the tip of the fastener engaging walls 860 and rounded edge 870. Continuing applied force to the fastener will force the jaw assembly apart as shown in FIG. 12 allowing the fastener to exit the assembly 325. Note that the walls 815 of adjacent jaws 310 abut each other, meaning the assembly 325 has a closed end. As the fastener exits the assembly 325, portions of the rolled edge 870 and/or wall 870 will maintain a constant pressure on two sides of the fastener exiting the tool 100. Once the main portion of the fastener has moved the jaws apart as shown in FIG. 12, the angle of walls 850 relative to the fastener will allow the fastener to move out of the tool until the head of the fastener reaches the wall 840 as shown in FIG. 13. The angle of wall 840 will further force the jaws apart, as shown in FIG. 14, allowing the fastener to completely exit the positioning assembly 325. The bit may be extended beyond the end of the jaw assembly 325 to position the fastener in the work piece.

Hence, when screws enter chamber 810 of assembly 325, any alignment issues will be addressed to center the screw so that it will enter the circular area defined by walls 830. Final alignment will be accomplished by walls 850 and 860, and rolled edge 870. As the fastener forces open the jaws between FIGS. 11 and 12, it will be precisely aligned along axis P to the point to which the installer has applied to tool.

It will be understood that many different types of fasteners and drivers may be utilized in accordance with the present invention. Advantageously, a powered screwdriver with collated screw strips may be utilized so that repeated use of the precise placement assembly facilitates multiple installation of fasteners. However, a power driver need not be used, but rather a hand driver may be used in conjunction with the precision placement mechanism. The accuracy in the precise placement assembly is superior to that of previous guides and enables a user to utilize power driven fasteners within a very small area of application. It will be further recognized that the assembly can be used with various sizes of screws by simply adjusting the dimensions of the interior cavity, the screw guide, or the guide assembly 325.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

We claim:

1. An apparatus for driving a threaded fastener, comprising:

a driver guide tube having a first end;

an elongated driver shaft in the guide tube having a rear end coupled to a power driver and a forward end carrying a bit, the driver shaft defining a longitudinal axis; and a positioning assembly positioned at the first end of the driver guide and engaging a fastener driven by the driver shaft out of the guide tube, including a first positioning jaw and a second positioning jaw symmetrically disposed in opposition to each other, each jaw rotatably coupled to the guide tube at a proximal end of the jaw, and each jaw having an interior cavity defined by a series of walls, including a first wall starting at the proximal end of the jaw having a first angle relative to the longitudinal axis, a second wall contiguous with the first wall and having a second angle relative to the longitudinal axis, the second angle is shallower than the first angle, the first wall having an elliptical cross section gradually decreasing in size relative to the longitudinal axis and the second wall having a generally circular cross section relative to the longitudinal axis, and a third wall contiguous with the second wall, the third wall coupled to a face by a rolled edge, each face having a planar surface extending from the rolled edge and abutting the corresponding planar surface of the face of the respective opposing positioning jaw, wherein the third wait, the face and rolled edge ensure that the fastener is aligned on the longitudinal axis.

2. The apparatus of claim 1 wherein each jaw includes a gear element having a plurality of teeth.

3. The apparatus of claim 2 wherein each jaw includes two gear elements, each gear element including a plurality of teeth offset with respect to each other such that the teeth mate with an opposing jaw positioned thereto.

4. The apparatus of claim 3 wherein the first and second jaw are rotatably coupled to the guide such that the face of each jaw abuts the face of the respective opposing jaw, the interior cavity of each jaw are in an opposing relation, and the gear elements of each jaw mesh.

5. The apparatus of claim 4 wherein the interior cavity includes a fourth wall and a fifth wall disposed between the second wall and the third wall.

6. The apparatus of claim 5 wherein the second wall has a width which is tapered from a width of the first wall at the lower portion to a third width at said fourth wall.

7. The apparatus of claim 1, wherein the first angle is approximately 11% and the second angle is approximately 3.8%.

8. An apparatus for positioning a fastener exiting a guide tube, comprising:

a first jaw having a partial interior cavity and a mounting portion allowing the jaw to be mounted at a proximal end thereof to the guide tube; and a second jaw having a partial interior cavity and a mounting tab allowing the jaw to be mounted at a proximal end thereof to the guide tube;

wherein the first and second jaw are rotatably coupled in opposition to each other to the guide tube in a retractable manner such that a fastener exiting the guide tube separates the jaws and is centered about an axis passing longitudinally through the guide tube; and wherein the partial interior cavity of each jaw is defined by a series of contiguous inner walls, including an upper portion having a first wall with a generally elliptical cross section of gradually decreasing size and a second wall with a generally circular cross section, the second wall adjoining a base portion having at least one additional wall coupled to a face wherein the at least one additional wall of the base portion has a larger angle relative to the axis than the walls of the upper portion, and the at least one additional wall of the base portion adjoining the face at a rolled edge at a distal end of each jaw, and wherein the face of the first jaw includes a planar surface extending from the rolled edge completely abutting an opposing planar surface extending from the rolled edge of the second jaw, the second jaw having a rolled edge engaging a fastener at one side of the planar surface.

9. The apparatus of claim 8 wherein the first wall has a first angle relative to the longitudinal axis and the second wall has a second, shallower angle relative to the axis.

10. The apparatus of claim 9 wherein the first and second jaw are rotatably coupled to the guide such that the face of each jaw abuts the face of the respective opposing jaw, the interior cavity of each jaw are in an opposing relation, and wherein each jaw includes a gear element having a plurality of teeth such that the gear elements of each jaw mesh.

11. The apparatus of claim 9 wherein each jaw includes two gear elements, each gear element including a plurality of teeth offset with respect to each other such that the teeth mate with an opposing jaw positioned thereto.

12. The apparatus of claim 9, wherein the first angle is approximately 11% and the second angle is approximately 3.8%.

13. The apparatus of claim 8 wherein said apparatus further includes a first spring associated with the first jaw and a second spring associated with the second jaw, each said jaw having a face partially surrounding each interior cavity, each said spring inducing said first jaw and second jaw into abutment at their respective faces.

14. The apparatus of claim 8 wherein the interior cavity includes a third wall and a fourth wall (850) disposed between the second wall (830) and the additional wall (860).

15. A power fastening system including a positioning apparatus, comprising:

a guide tube having a first end coupled to a power driver and a second end, the guide tube including a driving element therein, the driving element defining a longitudinal axis; and a positioning assembly positioned at the second end of the guide tube, the positioning assembly having a first positioning jaw and a second positioning jaw, each jaw rotatably coupled to the guide tube at a proximal end of the jaw and rotating to open at a distal end of the jaw, the first and second positioning jaw each including an interior cavity defined by a series of walls, including a first wall, a second wall, and a third wall, the third wall adjoining a face, the first wall starting at the proximal end of the jaw and having an elliptical cross section relative to the axis such that end portions of the first wall are located farther from the axis than a center portion of the first wall, the second wall contiguous with the first wall and having a generally circular cross section relative to the axis, the third wall having a larger angle relative to the axis than the first and second walls, the face contiguous with the third wall via a rolled edge, the face having a planar surface parallel to the axis, each planar surface abutting the corresponding opposing face of the respective opposing positioning jaw, the positioning assembly aligning a fastener exiting the guide tube and driven by the driving element along the axis in two dimensions generally perpendicular to the axis.

16. The system of claim 15 wherein the system includes a guide channel receiving a screwstrip transverse to the axis and a pawl member adapted for engagement with the screwstrip to advance the screwstrip in the guide channel with movement of the pawl member towards the axis.

17. The apparatus of claim 16 wherein each jaw includes a gear element having a plurality of teeth arranged offset with respect to each other such that the teeth mate with the respective opposing jaw positioned thereto.

18. The apparatus of claim 17 wherein the first and second jaw are rotatably coupled to the guide such that the face of each jaw abuts the face of the respective opposing jaw, the interior cavity of each jaw are in an opposing relation, and wherein each jaw includes a gear element having a plurality of teeth such that the gear elements of each jaw mesh.

19. The apparatus of claim 18 wherein the first wall has a width which is tapered from an upper portion of the first wall to a lower portion of the first wall.

20. The apparatus of claim 19 wherein the second wall has a width which is tapered from a width of the first wall at the lower portion to a third width at the third wall.

21. The apparatus of claim 15 wherein the interior cavity includes a fourth wall and a fifth wall (850) disposed between the second wall (830) and the third wall (860).

* * * * *